US005496483A

United States Patent [19]

Herrmann et al.

[11] Patent Number: 5,496,483

[45] Date of Patent: Mar. 5, 1996

[54] ELECTROVISCOUS LIQUID BASED ON DISPERSED MODIFIED POLYETHERS

[75] Inventors: Udo Herrmann, Dormagen; Günter Oppermann; Günther Penners, both of Leverkusen; Roland Flindt, Cologne; Hans-Horst Steinbach, Lindlar, all of Germany

[73] Assignee: Bayer AG, Leverkusen, Germany

[21] Appl. No.: 225,516

[22] Filed: Apr. 11, 1994

Related U.S. Application Data

[63] Continuation of Ser. No. 899,724, Jun. 17, 1992, which is a continuation-in-part of Ser. No. 620,845, Dec. 3, 1990, abandoned.

[30] Foreign Application Priority Data

Dec. 14, 1989 [DE] Germany ..... 39 41 232.6
Aug. 25, 1990 [DE] Germany ..... 40 26 880.2

[51] Int. Cl.[6] ..... C09K 3/00; C09K 5/00; C09K 5/06

[52] U.S. Cl. ..... 252/73; 252/78.1; 252/572; 252/573; 361/225; 361/226

[58] Field of Search ..... 252/73, 78.1, 572, 252/573; 361/225, 226

[56] References Cited

U.S. PATENT DOCUMENTS 4,702,855 10/1987 Goossens et al. ..... 252/75
4,738,797 4/1988 Halpern et al. ..... 252/49.3
4,772,407 9/1988 Carlson ..... 252/74
4,812,251 3/1989 Stangroom ..... 252/75
4,973,414 11/1990 Nerger et al. ..... 252/52 A
5,032,307 7/1991 Carlson ..... 252/73

FOREIGN PATENT DOCUMENTS 0387857 9/1990 European Pat. Off. .
0472991 3/1992 European Pat. Off. .
1-266191 10/1989 Japan .
2-26633 1/1990 Japan .
3-35095 2/1991 Japan .

*Primary Examiner*—Paul Lieberman
*Assistant Examiner*—Gregory R. Delcotto
*Attorney, Agent, or Firm*—Connolly & Hutz

[57] ABSTRACT

Disclosed are electroviscous liquid essentially containing

A) A linear and/or branched, eventually functionalized, polyether or the monomers thereof, the conversion product of such polyether resp. such monomer with mono- or oligo functional compounds and eventually additional additives, and B) a dispersing agent, and C) a non-aqueous dispersion-medium.

In an embodiment a cavity contains the electroviscous liquid and has parts movable with relation to each other and electrode means for generating an electrical field within the cavity wherein applying the electrical field increases the viscosity of the liquid.

8 Claims, 3 Drawing Sheets

ELECTROVISCOUS LIQUID BASED ON DISPERSED MODIFIED POLYETHERS

CROSS REFERENCE TO RELATED APPLICATION

This application is a continuation of U.S. application Ser. No. 07/899,724, filed Jun, 17, 1992, now abandoned, which is a continuation-in-part of U.S. application Ser. No. 07/620, 845, filed Dec. 8, 1990 now abandoned, filed for "Electoviscous Liquids Based On Dispersed Modified Polyethers" by Udo Herrmann, Guenter Oppemann, Guenther Penners, Roland Flindt, and Hans-Horst Steinbach.

INTRODUCTION

This invention relates to electroviscous dispersions which undergo an increase in viscosity on application of a voltage.

More particularly, this invention relates to control between relatively moving parts in an apparatus by the influence of an electric field upon an electroviscous liquid contained in the apparatus, or the control of a flow of electroviscous liquid in a device.

BACKGROUND OF THE INVENTION

Electoviscous liquids (EVLS) are dispersions of finely divided hydophilic solids in hydophobic, electrically non-conductive oils of which the viscosity may be increased very quickly and reversibly from the liquid to the plastic or solid state under the effect of a sufficiently strong electrical field. Their viscosity responds both to electrical d.c. fields and to a.c. fields. The current flowing through the EVL should be extremely low. Accordingly, EVLS may be used for any applications in which it is desired to control the transmission of powerful forces by low electric energy consumption, for example in clutches, hydraulic valves, shock absorbers, vibrators or systems for positioning and holding workpieces in position.

In addition to the requirements which an EVL generally has to satisfy, such as a good electroviscous effect, high temperature stability and chemical stability, the abrasiveness and anti-settling behavior of the disperse phase play an important part in practical application. Ideally, the disperse phase should not sediment, but at all events should be readily redispersible and should not cause any abrasion under extreme mechanical wear.

According to some prior art teachings, the disperse phase consists of organic solids, such as for example saccharide (DE 25 30 694), starch (EP 284 268 A2, U.S. Pat. No. 3,970,573), polymers (EP 150 994 A1, DE 33 10 959 A1, GB 1,570,234, U.S. Pat. No. 4,129,513), ion exchanger resins (UP 92278/1975, JP 32221/1985, U.S. 3,047,507), or silicone resins DE 39 12 888 A1).

Inorganic materials have also been used, including for example Li hydrazine sulfate (U.S. Pat. No. 4,772,407 A), zeolites (EP 265 252 A2), silica gel (DE 35 17 281 A1, DE 34 27 499 A1), aluminum silicates (DE 35 36 934 A1), $TiO_2$ (SU 715 596), $BaTiO_3$ (JP 53/17585) or metal powders, such as aluminum (UP 016093, UP 01172496). These solids were dispersed, in some cases with the aid of dispersants, in non-conductive, partly substituted liquids, such as for example hydrocarbons, aromatic hydrocarbons and silicone oil.

The disperse phase of these EVLS sediments in some cases very quickly, and is abrasive on account of the hardness of the particles dispersed therein.

Abrasion can be influenced to a large extent by the choice of the disperse phase. Polymeric substances are preferred to inorganic powders as the disperse phase.

Attempts have been made to solve the problem of sedimentation by using liquid phases of high specific gravity. Through the increase of the specific gravity of the liquid, for example by using fluorinated, chlorinated or brominated hydrocarbons, the difference in density between the liquid phase and the disperse phase decreases as, hence, does the sedimentation of the said particles. For example, to disperse the solids lithium polyacrylate, silica gel and salts of a crosslinked polymethacrylic acid, U.S. Pat. No. 4,502,973 uses halogenated diphenyl methane, EP-PS 284 268 A2 uses polychlorotrifluoroethylene and DE-PS 33 10 959 uses brominated diphenyl methane as the liquid phase. However, substituted liquids are generally not environment-friendly.

DE-OS 30 12 888 A1 describes a non-sedimenting EVL containing a fine powder of a silicone resin dispersed in an electrically insulating oil. However, these liquids have a relatively poor electroviscous effect.

SUMMARY OF THE INVENTION

The problem addressed by the present invention was to provide water free, non-abrasive, non sedimenting EVLS which have a high electroviscous effect and which despite their high content of the disperse phase are distinguished by their low basic (zero field) viscosity and low electrical conductivity.

It is an object of the present invention to provide an apparatus and a process with which it is possible to apply an electric field upon the electroviscous liquid according to the invention for the purpose of modifying the viscosity of the liquid and controlling the relative motion between moving parts in the apparatus. This invention also comprises a functional element (device) containing an anode and a cathode and the electroviscous liquid according this invention extending at least partly between said anode and said cathode, the function (property, mode of operation) of said element being altered by alteration of the electrical field between said anode and said cathode due to a change of viscosity of said liquid.

The EVL according to our invention comprises 1 to 80% by weight, preferably 1 to 60% by weight, particularly preferred 20 to 60% by weight, of a polyether which may have been modified by reaction with other chemical compounds (as hereinafter disclosed) dispersed in a non-conductive liquid.

In the apparatus of this invention, parts between which relative motion is to occur are provided with means for establishing an electrical field between electrodes, and the intervening space between the electrodes contain an electroviscous liquid (EVL) according to this invention. The apparatus include such functional devices as shock and vibration dampers, hydraulic valves, means for force transmission such as clutches, movement sensors. Generally, the function of such elements comprises influencing the flow of the liquid through a tube or hole, or the viscous friction between two planes (also concentric cylindrical planes), movable relative to each other, by the electrical field.

Examples for dampers are disclosed in De-A 3,920,347; DE-A 4,101,405; DE-A 4,120,099; U.S. Pat. Nos. 4,790, 522; 4,677,868; GB-A 1,282,568; DE-A 3,336,965; U.S. Pat. No. 5,104,829; EP-A 427,413; ED-A 183,039; DE-A 3,334,704; DE-A 3,330,205, U.S. Pat. No. 4,898,084.

Examples for clutches are disclosed in U.S. Pat. Nos. 4,802,560; 4,840,112; EP-A 317,186; U.S. Pat. Nos. 4,815,674; 4,898,266; 4,898,267; GB-A 2,218,758; DE-A 3,128,959; U.S. Pat. Nos. 2,417,850; 2,661,825.

Other functional elements are disclosed in WO 9108003 (electrohydraulic pump system for artificial hearts), GB-A 2,214,985 (fluid flow control valve), GB-A-3,984,086 (electroviscous vibrator) DE-A 4,003,298 (hydraulic pump or motor).

U.S. Pat. No. 5,014,829 discloses a shock absorber having a generally cylindrical inner casing holding an electroviscous fluid; a reciprocating arm means attached at one end of the cylindrical casing; a dampening plunger member coupled to said arm and extending into said electroviscous fluid, said dampening plunger being perforated to permit the flow of electroviscous fluid therethrough; Plunger and electrode means coupled to said perforated member for generating an electric field within said perforated member such that said electroviscous fluid within said perforated member solidifies, whereby said plunger applies a compressive fluid force against said fluid so as to provide a dampening force.

U.S. Pat. No. 2,661,825 discloses clutch in which several parts between which relative slip is to occur are provided with means for establishing a flux (either electric or magnetic) field between them, and the intervening space is charged with a flux field responsive medium.

Surprisingly, among the desirable results, it is found that in these apparatus and process of the present invention the electroviscous liquid is water free, non-abrasive, non sedimenting and has a high viscosity effect and also low basic viscosity and low electrical conductivity.

In the manufacture of the EVLS, the polyether may be mixed with other chemical compounds (such mixture hereinafter being called basic composition) and the basic composition may be dispersed in the non-conducting liquid. Preferably such mixture during dispersing is a liquid. Eventually the basic composition may further be chemically or physically modified by addition of suitable reactants and/or additives prior to, during or after dispersing it. By such reactants or additives the EVLS may be modified with regard to the consistency and) or the conductivity of the disperse phase by partial or complete reaction of the functional groups of the basic composition. In case the basic composition is a liquid a suitable dispersant is used during dispersing it. The size of the dispersed particles is in the range from 0.05 preferably from 0,1 um to 200 um. The viscosity of the EVLS at room temperature is in the range from 0,5 to 5000 $mm^2/s$, preferably 3 to 5000 $mm^2/s$.

In the manufacture of the EVLS the basic composition comprises at least one member selected from the group of (I) a linear or branched polyether eventually having functional groups;

(II) the reaction product of (I) with mono- and/or oligofunctional compounds such as polyols, aliphatic carbonic acids or amine, alcohols, esters, etc.,;

(III) a mixture from (I) and/or (II) with other non-reactive Additives, which in the final EVL may modify the electrical and/or the mechanical properties of the disperse phase, as there is conductivity and deformation behavior. Additives (III) may comprise masked low molecular polyethers, e.g. bismethylized trimethylpropane or ethers of phthalic acid, which function as softeners.

As linear polyethers may be used polyethylene glycols, polypropylene glycols, polybutylenglycols, statistical ethylenglycol-propylenglycol-copolymerizates or ethyleneoxide-propyleneoxide-block polymerisates, such as available under trade name "pluronic" from GAF. Branched polyethers are e.g. tris (polypropylenoxide)w-ol) glycidether or other compounds obtained from ethoxylation of propoxylation of higher functional hydroxy-compounds, such as pentaerythrite or 1,1,1-trimethylol propane. The molecular weight of the polyglycols is between 62 and 1,000,000, preferably below 100,00, particularly preferred between 100 and 10,000. The polyglycols may contain functional end groups such as amine, allyl, vinyl or carboxylic acid groups. Useful polyethylen—resp. polypropylen—mono—or diamines are available under trade name "Jeffamin" of Texaco. Compounds containing acrylic groups are e.g. esters of glycols with respective acids e.g. acrylic acid.

Members of group (II) are e.g. polyesters available under trademark name "Desmophen" of Bayer AG.

In case the basic composition is liquid a cross-linking additive (IV), may be added prior to or after dispersing. The additive reacts with the functional end groups of (I), (II) and/or (III) and thereby increases the molecular weight in the dispersed particles and/or reduces the number of functional end groups. Depending on type and amount of components (I), (II) and/or (III) and the additive (IV) viscous or solid particles are formed under preservation of the spherical shape of the liquid particles as dispersed.

Suitable cross linking agents are di-or trifunctional isocyanates with wide variety in structure. Such cross linking agents are e.g. available under trade name "Desmodur" from Bayer AG. In case of uses of tri-or higher functional glycols the use of toluylen-diisocyanate is particularly preferred. Also acetate-, amine, benzamid-, oxim- and alkoxy- cross-linking agents known in silicone-chemistry may be used with advantage. Preferably the cross-linking agent is used in such amount that 20 to 100%, particularly preferred at least 80%, of OH-groups present in the glycol are reacted.

The disperse phase consisting of the basic composition and additive (IV) shall be present in the EVLS in amounts of 10 to 85% by weight, preferably 40 to 70% by weight.

As the dispersing medium are useful liquid hydrocarbons, such as for example paraffins, olefins and aromatic hydrocarbons, and preferably silicone oils, such as polydimethyl siloxanes, and liquid methyl phenyl siloxanes. They may be used individually or in combination of two or more types. The solidification point of the dispersion medium is preferably lower than −30° C. while their boiling point is above 150° C. The viscosity of the oils at room temperature is between 3 and 300 $mm^2/s$. Low-viscosity oils having a viscosity of 3 to 20 $mm^2/s$ are generally preferred because a low basic viscosity of the EVLS is obtained in their case.

In addition, to avoid sedimentation, the oil should have a density substantially corresponding to the density of the disperse phase.

By use of fluorine containing siloxanes, purely or in mixture with other oils, as the dispersion medium EVLS may be obtained, which show no sedimentation over weeks and also a low basic viscosity.

Particularly preferred as the dispersion medium are fluorine containing siloxanes of general structure:

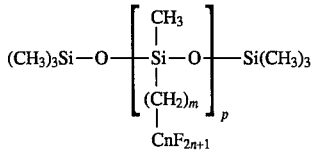

wherein:

n=1 to 10 m=2 to 18 p=1 to 5

Surfactants soluble in the dispersion medium which are derived, for example, from amines, imidazolines, oxazolines, alcohols, glycol or sorbitol may be used as dispersant for the disperse phase. Polymers soluble in the dispersion medium may also be used. Suitable polymers are, for example, polymers containing 0,1 to 10% by weight N and/or OH and 25 to 83% by weight $C_{4-24}$ alkyl groups and having a molecular weight in the range from 5,000 to 1,00,000. The N– and OH-containing compounds in these polymers may be, for example, amine, amide, imide, nitrile, 5- to 6-membered N-containing heterocyclic rings or an alcohol while the $C_{4-24}$ alkyl groups are esters of acrylic or methacrylic acid. Examples of the N- and/or OH-containing compounds are N,N-dimethylaminoethyl methacrylate, tertiary butyl acrylamide, maleic imide, acrylonitrile, N-vinyl pyrrolidone, vinyl pyridine and 2-hydroxyethyl methacrylate.

The polymeric dispersants mentioned generally have the advantage over the low molecular weight surfactants that the dispersions prepared with them are more stable in their settling behavior.

Polysiloxane/polyether copolymers corresponding to general formulae (1) to (4) are particularly suitable for dispersion in silicone oil:

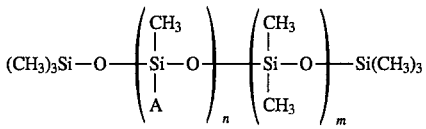

(1)

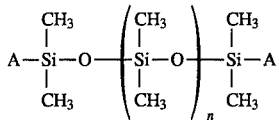

(2)

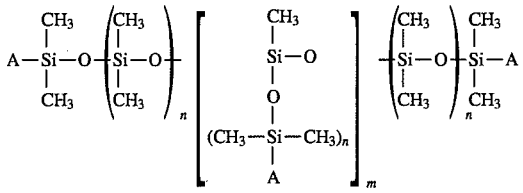

(3)

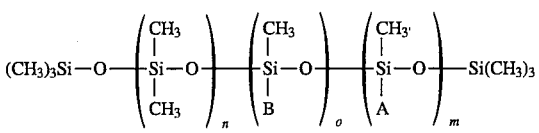

(4)

where $A=(CH_2)_3—O—(C_2H_4O)_x—(C_3H_6O)_y—H$ $=(CH_2)_3—O—(C_2H_4O)_x—(C_3H_6O)_y—CH_3$ $=O—(C_2H_4O)_x—(C_3H_6O)_y—C_4H_9$ $B=(CH_2)p12—CH_3$ $1<x<300$ $0<y<300$ $1<p<100$ $1<o<300$ Polysiloxane polyethers corresponding to the above formulae are commercially available from Goldschmidt AG, Essen (Federal Republic of Germany), under the name of "Tegopren".

Particularly preferred dispersants for the production of the EVL are polysiloxane polyethers corresponding to general formula (1) with a ratio by weight of ethylene oxide to propylene oxide of about 1:1. Such products with a ratio of 49:51 are marketed by Goldschmidt under the name of "Tegopren 5830".

Other preferred dispersing agents are reaction products of hydroxy-functional polysiloxanes with various types of silanes. Particularly preferred from this group of dispersing agents are reaction products of hydroxy-functional polysiloxanes with amino silanes.

The dispersing agent is used in amounts of 0,1 to 5, preferably 0,5 to 3% by weight of the ELVS.

The EVLS according to the invention prepared with silicone oil are highly compatible with elastomeric materials, particularly rubber. In addition, they are resistant to high and low temperatures over an unusually wide temperature range and show minimal dependence of pressure in their viscosity. In addition, the electroviscous dispersions according to the invention show high dielectric strength. Another advantage of the described EVLS is that they do not sediment and are non-abrasive.

As pointed out above, this invention includes the means and the method for controlling the relative motion between elements of a device having a cavity or chamber with electrodes and an electroviscous liquid according to this invention. These and other features of the present invention will be more fully understood in view of the following detailed description taken together with the accompanying drawing.

DESCRIPTION OF THE REPRESENTATIVE EMBODIMENTS

Figure 1:
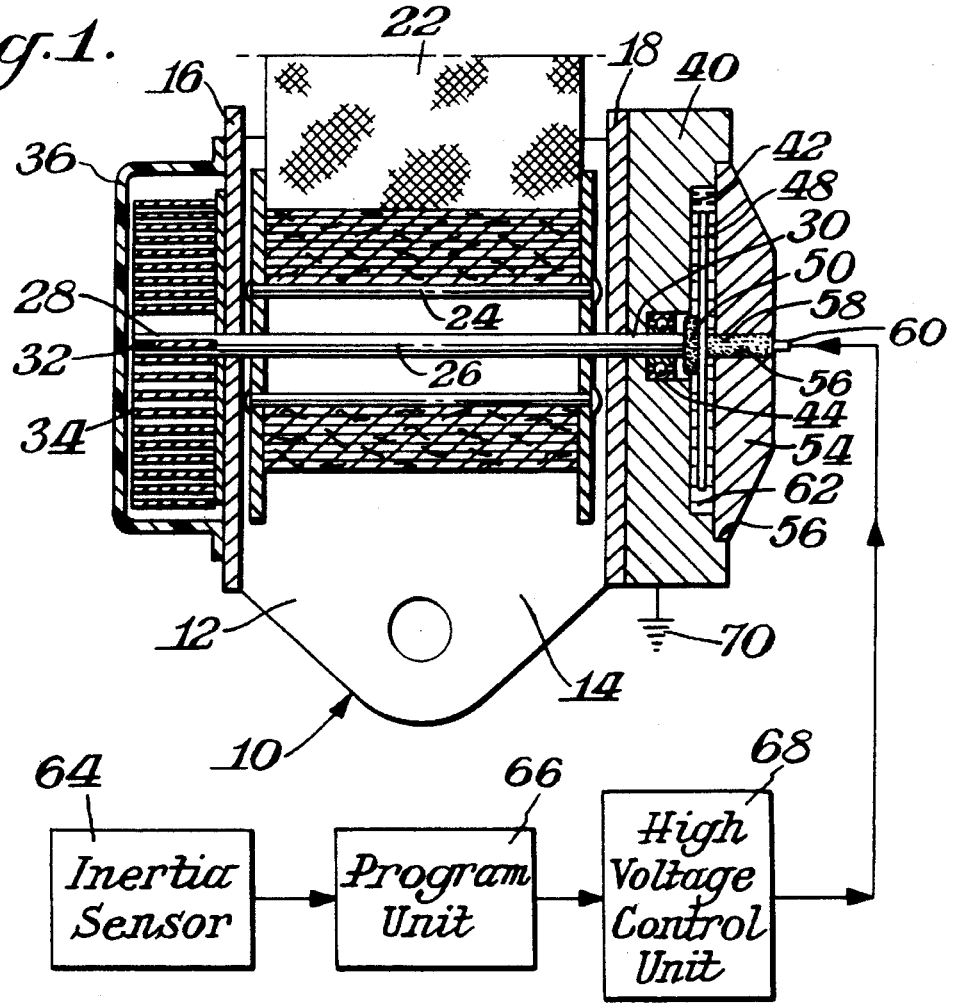
FIG. 1 illustrates a representative embodiment of the present invention in a seat belt reel having electroviscous liquid and means for influencing the viscosity.

An embodiment of the present invention as illustrated by the device of U.S. Pat. No. 4,815,674 is referred to here and shown in FIG. 1. In this representation of the present invention, the elctroviscous liquid of the present invention is used in a cavity having electrodes with means capable of creating an electric field across the electrodes and the liquid for controlling the relative motion of parts of the representative embodiment.

Seat belt retractor 10 includes a retractor housing 12 with a base wall 14 and spaced apart sidewalls 16 and 18. The seat belt 22 is wrapped around a belt reel 24. The reel 24 is mounted on the retractor housing 12 by a reel shaft 26 which has a left hand end 28 extending through the retractor side wall 16 and a right hand end 30 extending through the retractor side wall 18.

The left hand end 28 of the reel shaft 26 has a slot which receives the inner end 32 of a spiral spring 34. The outer end of the spiral spring 34, not shown, is mounted on a spring housing 36 which is attached to the retractor side wall 16. The spiral spring 34 works to bias the reel shaft 26 in the belt winding direction of rotation.

A locking mechanism is provided on the right hand end 30 of the reel shaft 26. A housing member 40 of electrically conductive material, is mounted don the retractor sidewall 18 and has an outwardly facing cavity 42 defined therein. The right hand end 30 of the reel shaft 26 extends into a cavity 42 and is rotatably journal therein by a roller bearing assembly 44.

An electrode 48, in the shape of a disk, is situated in the cavity 42 and is mounted on the right hand end 30 of the reel shaft 26 by a connector 50. The connector 50 is constructed of a dielectric material so that the electrode 48 is electrically insulated from the reel shaft 30.

A housing cover 54 constructed of an electrically conductive material is seated within a recess 56 of the housing member 40 and closes the cavity 42. The housing cover 54 attached to the electrode 48. An electrical conductor 60 extends through the bushing 58 and is attached or otherwise electrically connected with the electrode 48.

As seen in the drawing, the electrode 48 is suspended within the cavity 42 so that belt winding unwinding rotation of the reel and the reel shaft 26 will cause the electrode 48 to rotate within the cavity 42.

The cavity 42 is filled with an electroviscous liquid according to this invention. The electrode 48 passes through this fluid upon rotation of the reel.

An electrical circuit is provided and attached to the conductor 60 and the housing 40 to subject the electroviscous fluid 62 to a high voltage. The electrical circuit includes a inertia sensor switch 64, a program unit 66, and a high voltage control unit 68 which are connected to the conductor 60 and the ground 70 of the housing member 40. When the inertia sensor switch senses a vehicle deceleration of a predetermined magnitude, a signal is provided to the program unit which in turn energizes the high voltage control unit to subject the electrode 48 and the housing 40 to a high voltage differential.

The electroviscous liquid 62 is exposed to this electric field and undergoes the electroviscous effect in which the viscosity of liquid 62 is increased, and the electrode 48 is fixed against rotation.

Figure 2:
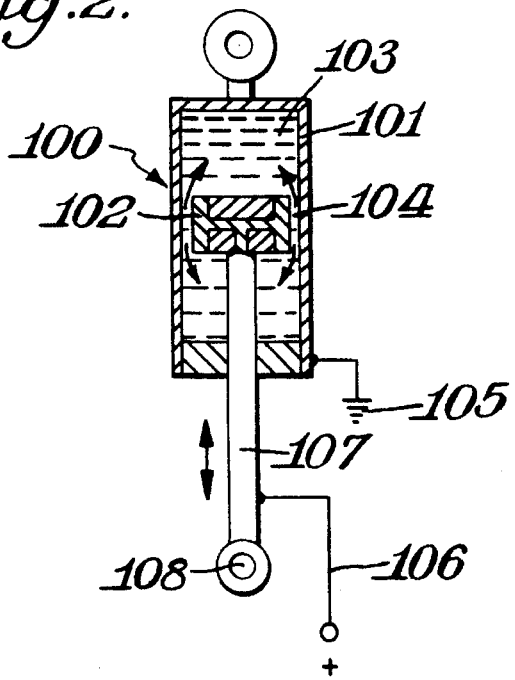
FIG. 2 illustrates a representative embodiment of the present invention in a shock absorber having electroviscous liquid and means for influencing the viscosity.

In the embodiment illustrated in FIG. 2, a shock absorber 100 is comprised of a conductive cylinder 101 containing a conductive piston 102 reciprocable within the cylinder 101 and an electroviscous liquid 103 as defined above which passes through a passage 104 between the piston 102 and the cylinder 101. Circuit means in the form of a ground connection 105 and a wire 106 to a power source electrifies the piston 102 and the cylinder 101 as positive and negative electrodes respectively. The piston 102 is mounted on a piston rod 107 and the rod 107 rides on a shaft 108 in conventional fashion.

The passage 104 permits the liquid 103 to flow past the piston 102 as the piston 102 moves back and forth within the cylinder 101. The flow of liquid 102 through the passage 104 is influenced by the relative viscosity of the liquid 103. The piston 102 and the cylinder 101 electrified by the circuit means attached thereto generate an electric filed within the cylinder 101 and at the passage 104, such that in the electroviscous liquid 103 of the present invention as the electrical filed strength is increased, the shear stress as measured on a viscosimeter is increased. The present invention is distinguished by the very good electroviscous effects of the liquid 103 of superior properties as mentioned elsewhere in the presently description.

The electroviscous liquid 103 flows thru the passage 104 until the piston 102 and the cylinder 101 are electrified. When the electrode-nature of these parts is electrified, the liquid 103 contained within the passage 104 becomes more viscous in keeping with the strength of the electric field and the flow is impeded. Thus this invention provides with the electroviscous liquid of the invention a variable dampening effect in the vibrations of the shock absorber 100 in use.

In a typical method for producing the EVLS, the basic compounds and the reactive additive (IV) (cross-linking agent) are mixed. After homogenization the mixture is dispersed in the surfactant-containing liquid phase (dispersion medium). After dispersion, the temperature of the dispersion formed is increased to a value of preferably 15°–150° C., depending on the reactivity of the crosslinking agent.

In an alternative method, the crosslinking agent is only incorporated in the dispersion after the dispersion step.

In a third method of production the glycol or the polyester with or without surfactant and the crosslinking agent are sprayed to form a fine powder and the powder formed is subsequently dispersed in the liquid phase.

However, the method of production is not critical to the final properties of the EVLS. For example, it is possible to use simple stirrers, ball mills, shearing homogenizers, high-pressure homogenizers or ultrasound.

However, dispersion should be carried out in such a way that the particle size does not exceed 200 um, preferably 100 um.

The EVLS thus produced were investigated in a modified rotational viscosimeter of the type described by W. M. Winslow in J. Appl. Phys. 20 (1949), pages 1137–1140.

The electrode area of the inner rotating cylinder 50 mm in diameter measures approx. 78 $cm^2$ and the gap width between the electrodes is 0.50 mm. For the dynamic measurements, the maximum shear rate may be adjusted to 2,640 $s^{-1}$. The maximum measuring range of the shear stress of the viscosimeter is 750 Pa. Both static and dynamic measurements are possible with this modified viscosimeter. The EVLS may be excited both with d.c. and with a.c. voltage.

Where d.c. voltage is used, it may happen with certain liquids that, in addition to the spontaneous increase in viscosity or in the yield point when the filed is switched on, the solid particles are also slowly deposited on the electrode surfaces, particularly at low shear rates or in the case of static measurements. Accordingly, testing of the EVLS is preferably carried out with a.c. voltage and under dynamic shear stress. Readily reproducible flow curves are obtained in this way.

Figure 3:
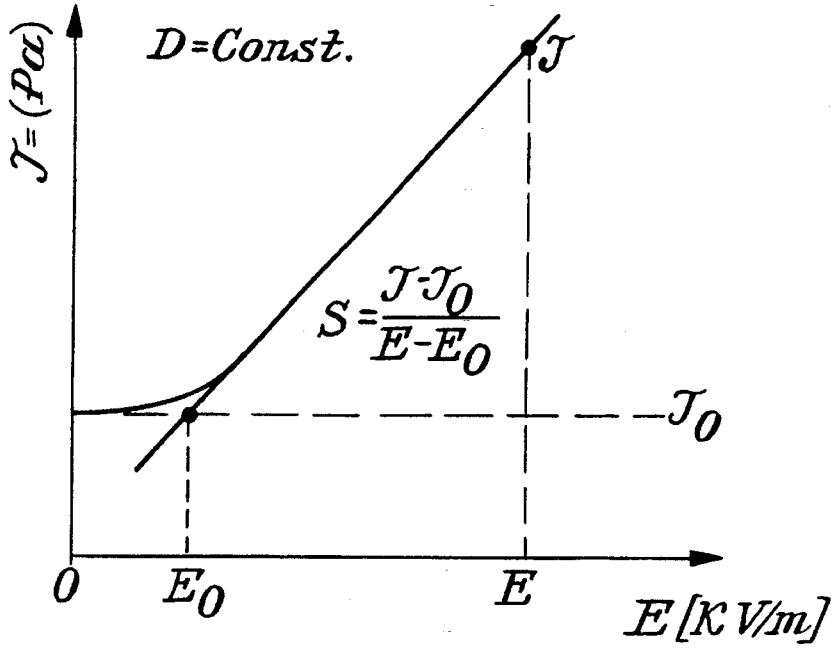
FIG. 3 is a chart plotting effective field strength against shear stress.

To determine electro reactivity, a constant shear rate $0<D<2{,}640\ s^{-1}$ is adjusted and the shear stress T is measured as a function of the electrical field strength E. With the test apparatus, it is possible to generate alternating fields up to a maximum effective field strength of 2,370 kV/m for a maximum effective current of 4 mA and a frequency of 50 to 550 Hz. However, the measurement is preferably carried out at 50 Hz because the total current is then at its lowest so that the electrical power required is also at its lowest. The flow curves obtained are as shown in FIG. 1. It can be seen that the shear stress T shows a parabolic increase at low field strengths and a linear increase at higher field strengths. The gradient S of the linear part of the curve is apparent from FIG. 3 and is expressed in Pa.m/kV. The threshold value $E_o$ of the electrical field strength is determined form the point of intersection between the straight line S and the straight line $T=T_o$ (shear stress without an electrical filed) and is expressed in KV/m. The increase in the shear stress $T(E)-T_o$ in the electrical field $E>E_o$ may be calculated in accordance with the following equation:

$$T(E)-T_o=S(E-E_o)$$

In the following Examples, Comparison Examples 1 to 3 correspond to the prior art, being based on Examples 6, 7 and 9 of German patent DE 35 36 934 A1. The liquids described in these Examples are distinguished by particularly good electroviscous properties.

Examples 1 to 12 relate to electroviscous liquids according to the invention.

The electroviscous properties of the EVLS according to the invention and the comparison liquids at different temperatures are shown in Table I.

Figure 4:
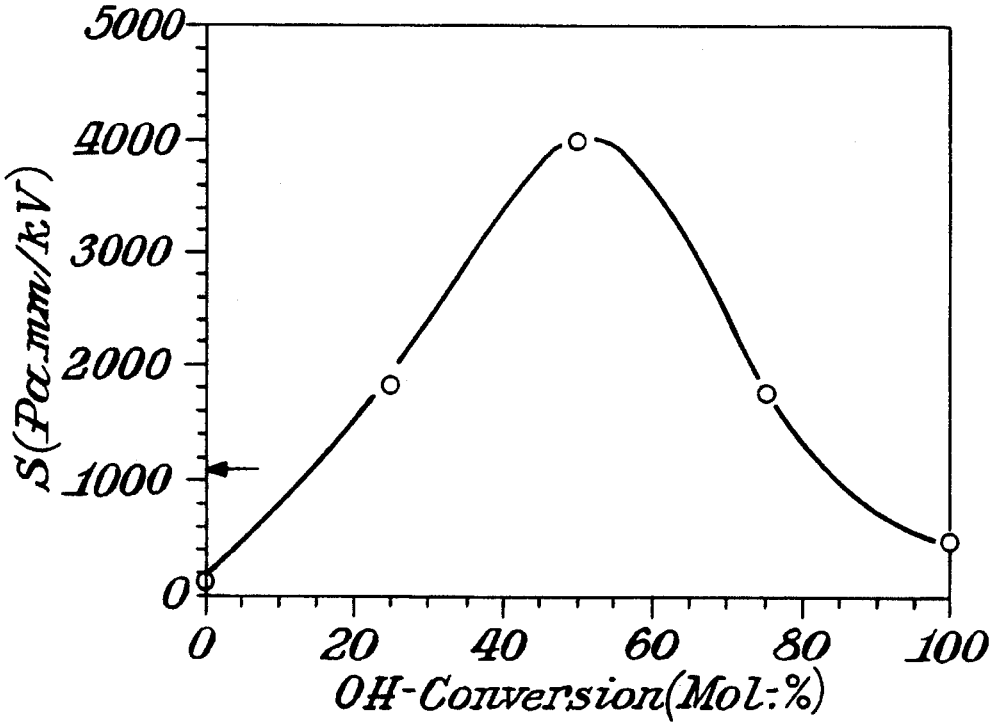
FIG. 4 is a chart of electroviscous effects plotted against a quantity of isocyanate-reacted hydroxyl groups.
Figure 5:
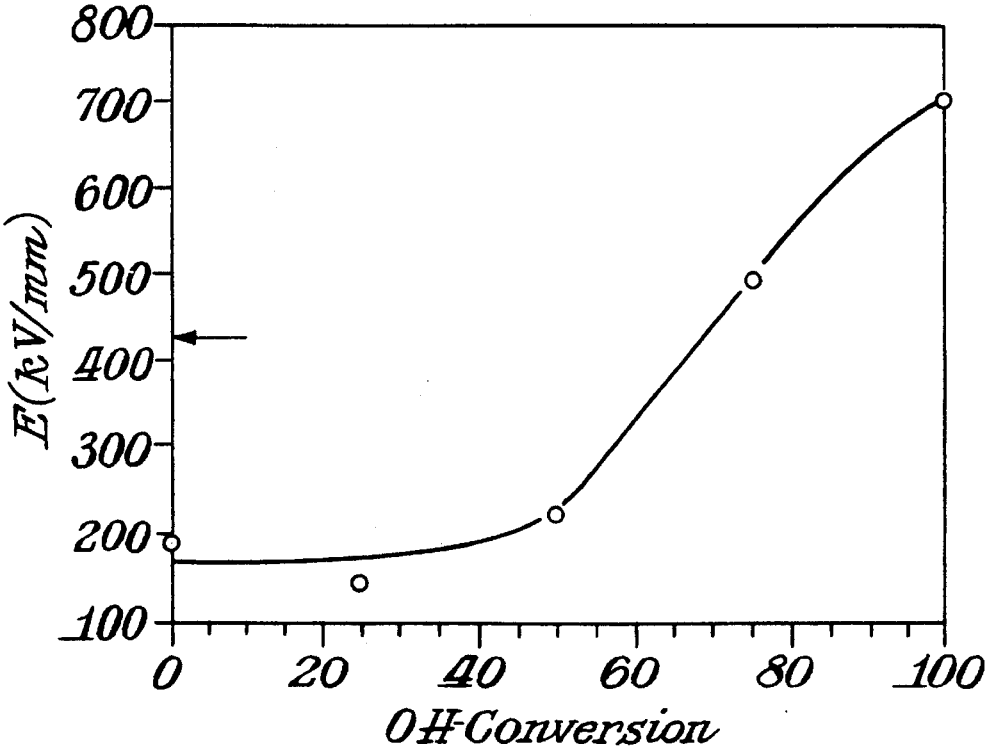
FIG. 5 is a chart of electrical field strength, $E_o$, plotted against a quantity of isocyanate-reacted hydroxyl groups.
Figure 6:
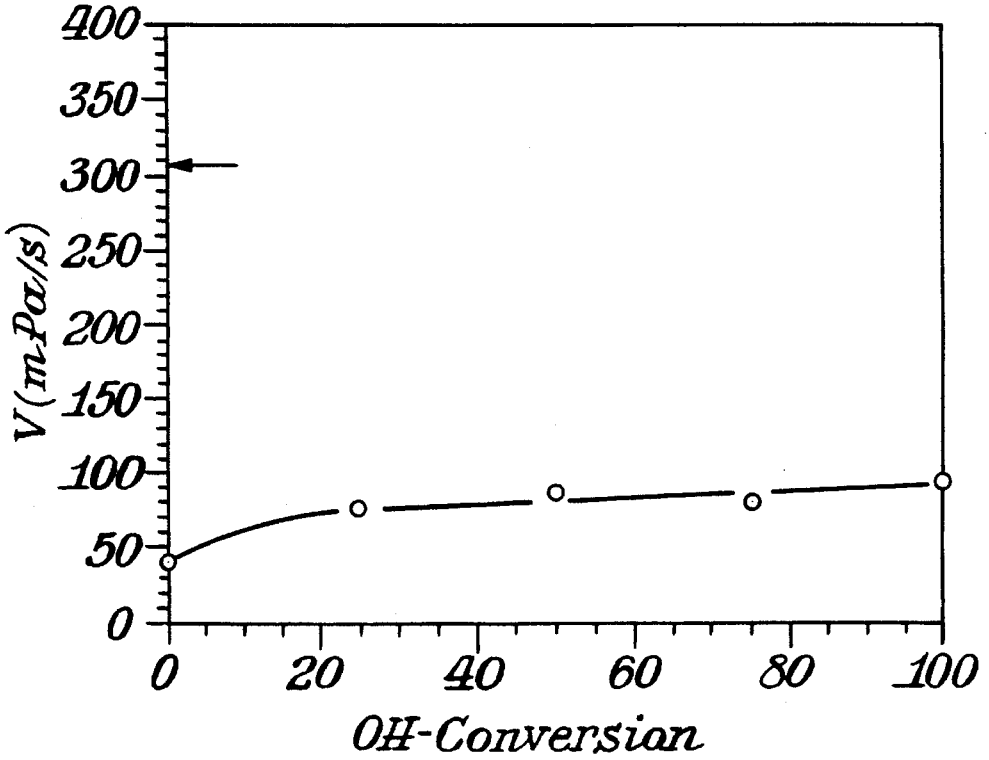
FIG. 6 is a chart of viscosity, V, plotted against a quantity of isocyanate-reacted hydroxyl groups.

FIGS. 4 to 6 illustrate the correlation between certain properties (electroviscous effect S, threshold value of the electrical field strength $E_o$ and viscosity V at a rotational speed of the rotor of 500 r.p.m.) of the EVLS according to the invention describes in Examples 1 to 5 and the quantity of isocyanate-reacted hydroxyl groups at a measuring temperature of 25° C. By way of comparison, the arrows on the ordinate indicate typical values for an EVL according to Comparison Example 2. It should be particularly emphasized that many EVLS according to the invention are distinguished by very good electroviscous effects despite their low viscosity and their low threshold field strength.

EXAMPLES

Dispersion medium:

(a) polydimethyl siloxane (silicone oil)
viscosity at 25° C.: 5 $mm^2/s$
density at 25° C.: 0,9 $g/cm_3$
dielectric constant
$E_r$ according to DIN 53 483
at 0° C./50 Hz: 2,8.

(b) 1,1,1,2,3,3,3-heptamethyl-2-perfluor-hexyl-ethyltrisiloxane

Dispersed phase:

(a) polyethylen glycol, molecular weight 400

(b) tri-functional polyethylenglycol, molecular weight 675, obtained by ethoxylation of trimethylpropane.

Dispersant:

(a) Tegopren 5830, a, w-polyether/polydimethyl siloxane copolymer corresponding to formula (2)

(b) reaction product of 100 parts by weight of an OH-end-stopped polydimethyl siloxane of average molecular weight 18,200 and one part amino-propyl-triethyoxy-silane.

Crosslinking (a) toluylene diisocyanate (TDI)

(B) tri-acetoxy methylsilan

Example 1

1,25 g of the dispersant (a) are dissolved in 20 g of the dispersion medium (b). In a 100 ml glass beaker, 17,5 g of the glycol (a) are emulsified into this solution at 25° C. by means of a rotor-stator shearing homogenizer (Ultra-Turrax T 25, IKA Labortechnik). The emulsification time at a rotor speed of 10,000 r.p.m. is 3 minutes. 7,61 g of the crosslinking agent (a) are added dropwise with stirring to the resulting emulsion. For a quantitative reaction, this quantity of crosslinking agent results in stoichiometric reaction of the hydroxyl groups in the glycol. Accordingly, this quantity corresponds to an OH conversion of 100 mol %. After addition of the crosslinking agent, the samples were stirred at low speed using a propeller stirrer.

Example 2

An EVL was prepared as described in Example 1, but with a quantity of 5,71 g of the crosslinking agent. This corresponds to an OH conversion of 75 mol-%.

Example 3

Preparation as in Example 1, but with a quantity of 3,81 g of crosslinking agent (OH conversion 50 mol-%).

Example 4

Preparation as in Example 1, but with a quantity of 1,90 g of crosslinking agent (OH conversion 25 mol-%).

Example 5

The EVL was prepared in the same way as described in Example 1, except that no crosslinking agent was added so that the conversion of the hydroxyl groups of the glycol was 0 mol-%.

Example 6

0,6 g of the dispersant (b) are dissoluted in 20 g of the dispersion medium (a), 17,5 g of glycol (a) are mixed with 7,61 g of crosslinking agent (a). This amount of the crosslinking agent corresponds to stochiometric reaction of the OH-groups of the glycol, accordingly corresponds to an OH-conversion of 100 mol-%. The mixture is emulsified in the dispersion medium immediately as in Example 1. Thereafter 48 hours are allowed for the reaction to take place at room temperature.

Example 7

Preparation as in Example 6, but with a quantity of 5,71 g of crosslinking agent (OH conversion 75 mol-%).

Example 8

Preparation as in Example 6, but with a quantity of 3,81 of crosslinking agent (OH conversion 50 mol-%).

Example 9

Preparation as in Example 6, but with a quantity of 1,90 g of crosslinking agent (OH conversion 25 mol-%).

Example 10

0,6 g of dispersant (b) are dissoluted in 20 g of dispersion medium (a). 15,0 g of trifunctional glycol (b) are mixed with 6,79 g of crosslinking agent (a) corresponding to OH-conversion 100 mol-%. Preparation procedure as in Example 6. Reaction time 8 hours at 90° C.

Example 11

0,5 g of dispersant (b) are dissoluted in 20 g of the dispersion medium (a). 15,0 g of bifunctional glycol (a) are mixed with 4,14 g of crosslinking agent(b) corresponding to OH-conversion 75 mol-%. Preparation and reaction as in Example 6.

Example 12

0,6 g of dispersant (b) are dissoluted in 20 g of dispersion medium (b), 17,5 g of trifunctional glycol (b) are mixed with 6,79 g of crosslinking agent (a) corresponding OH-conversion of 100 mol-%. Preparation and reaction as in Example 10.

Centrifugation of the sample (30 min at 2000 g) did not lead to a visible separation of the disperse phase from the dispersion medium. A sample prepared according to Comparison Example 2 showed after centrifugation segregation of the disperse phase at the bottom of the tube in the form of a solid sediment. The sediment could only redispersed by application of strong shear.

Comparison Example 1

In accordance with Example 6 of German patent 35 36 934 A1, 50 parts by weight an erionite (composition: 62% by weight $SiO_2$, 18% by weight $Al_2O_3$, 10% by weight $Na_2O$) were dispersed in 50 parts by weight of a polydimethyl siloxane silicone oil having a viscosity of 5 $mm^2/s$ (at 25° C.). The moisture content of the erionite, as determined in accordance with DIN 55 921, was 6% by weight. 2,5 Parts by weight of dispersant 1 (aminofunctional siloxane) described in the test specification were used as dispersant.

Comparison Example 2

In accordance with Example 7 of German patent 35 36 934 Al, 40 parts by weight an Al silicate (composition: 75% by weight $SiO_2$, 9% by weight $Al_2O_3$, 7% by weight $Na_2O$) were dispersed in 60 parts by weight of a polydimethyl siloxane silicone oil having a viscosity of 5 $mm^2/s$ (at 25° C.). The moisture content of the Al silicate, as determined in accordance with DIN 55 921, was 6% by weight. 6 Parts by weight of dispersant 1 described in the patent specification were used as dispersant.

Comparison Example 3

In accordance with Example 9 of German patent 34 36 934 Al, 50 parts by weight of a zeolite Y (Na form) (composition: 58% by weight $SiO_2$, 20% by weight $Al_2O_3$, 12% by weight $Na_2O$) were dispersed in 50 parts by weight of a polydimethyl siloxane silicone oil having a viscosity of 5 $mm^2/s$ (at 25° C.). The moisture content of the zeolite Y, as determined in accordance with DIN 55 921, was 6% by weight. 2,5 Parts by weight of dispersant 1 described in the patent specification were used as dispersant.

TABLE I

| | properties | | | | | |
|---|---|---|---|---|---|---|
| | 25° C. | | | 90° C. | | |
| EVLS acc. to | Eo kV/m | S Pa · mm/kV | V* mPa · s | Eo kV/m | S Pa · mm/kV | V* mPa · s |
| Example 1 | 712 | 483 | 94 | 232 | 1005 | 232 |
| Example 2 | 500 | 1773 | 81 | 96 | 2274 | 96 |
| Example 3 | 228 | 3997 | 87 | 176 | 212 | 176 |
| Example 4 | 148 | 1840 | 77 | — | — | — |
| Example 5 | 193 | 139 | 42 | — | — | — |
| Example 6 | 1144 | 240 | 95 | 388 | 2240 | 22 |
| Example 7 | 1364 | 635 | 82 | 176 | 810 | 20 |
| Example 8 | 404 | 4146 | 61 | 124 | 96 | 25 |
| Example 9 | 324 | 1207 | 52 | — | — | — |
| Example 10 | 1560 | 75 | 96 | 776 | 467 | 38 |
| Example 11 | 180 | 1114 | 55 | — | — | — |
| Comp. Ex. 1 | 192 | 2104 | >300 | 241 | 1341 | — |
| Comp. Ex. 2 | 433 | 1039 | 300 | 428 | 836 | — |
| Comp. Ex. 3 | 229 | 1556 | >300 | 250 | 899 | — |

*Viscosity at shear of 1.000 $sec^{-1}$.

We claim:

1. A process for making electroviscous liquid, comprising:

dispersing (a) a linear or branched polyether having functional groups in an amount of 20% to 60% by weight of the electroviscous liquid, and (b), a cross-linking agent selected from the group consisting of difunctional isocyanates, trifunctional isocyanates, acetate cross-linking agents, benzamid cross-linking agents, oxim cross-linking agents, or alkoxy cross-linking agents, wherein the cross-linking agent (b) is used in a sufficient quantity to react with 20–100% of the OH-groups of the polyether and that the sum of (a) and (b) is 40–70% by weight of the electroviscous liquid, in (c) a non-aqueous dispersion medium, in the presence of (d) 0.1 to 5.0% by weight based on the electroviscous liquid of a dispersing agent soluble in the dispersion medium, whereby particles of a mixture of (a) & (b) are formed, said particles having a diameter of 0.5 to 200 microns, and reacting the polyether with the cross linking agent.

2. A process according to claim 1, wherein the polyether (a) is selected from the group consisting of polyethylene glycols, polypropylene glycols, polybutylenglycols, statistical ethylenglycol-propylenglycol-copolymerizates, propylenoxide-block-copolymerisates, tris(polypropylenoxide)ω-ol)glycidether, compounds obtained from ethoxylation or propoxylation of pentaerytrol or 1,1,1-trimethylolpropane.

3. A process according to claim 1, wherein the polyether (a) has a molecular weight of 62 to 1,000,000.

4. A process according to claim 1, wherein the polyether (a) has a molecular weight of 100 to 10,000.

5. A process according to claim 1, wherein the dispersion medium (c) is a silicone oil having a viscosity of 3 to 300 $mm^2/s$ at room temperature.

6. A process according to claim 5, wherein the dispersion medium (c) comprises a fluorine containing siloxane.

7. A process according to claim 1, wherein the dispersion agent (d) is an alkoxy polysiloxane.

8. A process according to claim 1, wherein the dispersion agent (d) is a polysiloxane-polyether-copolymerizate.

* * * * *